US006974063B2

(12) United States Patent
Schiestl et al.

(10) Patent No.: US 6,974,063 B2
(45) Date of Patent: Dec. 13, 2005

(54) COMBUSTION-ENGINED SETTING TOOL

(75) Inventors: Ulrich Schiestl, Feldkirch (AT); Hans Gschwend, Buchs (CH); Peter Hertlein, Gams (CH); Ulrich Rosenbaum, Wangs (CH); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/828,763

(22) Filed: Apr. 20, 2004

(65) Prior Publication Data

US 2005/0001002 A1 Jan. 6, 2005

(30) Foreign Application Priority Data

Apr. 24, 2003 (DE) ..... 103 18 554

(51) Int. Cl.[7] ..... B25C 1/14
(52) U.S. Cl. ..... 227/9; 227/10
(58) Field of Search ..... 227/8, 10, 130, 227/2, 5, 9; 123/46 SC, 46 R

(56) References Cited

U.S. PATENT DOCUMENTS 5,000,128 A * 3/1991 Veldman ..... 123/46 SC
6,123,241 A * 9/2000 Walter et al. ..... 227/8
6,145,724 A * 11/2000 Shkolnikov et al. ..... 227/8
6,158,643 A * 12/2000 Phillips ..... 227/130
6,260,519 B1 * 7/2001 Phillips ..... 123/46 R
6,279,517 B1 * 8/2001 Achten ..... 123/46 R
6,722,548 B2 * 4/2004 Odoni et al. ..... 227/8
6,783,047 B2 * 8/2004 Granacher ..... 227/10

* cited by examiner

*Primary Examiner*—Scott A. Smith
(74) *Attorney, Agent, or Firm*—Abelman, Frayne & Schwab

(57) ABSTRACT

The present invention relates to a combustion-engined setting tool for driving fastening elements, such as nails, bolts, pins in a constructional component, with a fuel guide (12) extending from a fuel source (11) to a combustion chamber (13) and with at least on electronically controlled valve (24) which is arranged in the fuel guide (12) between the fuel source (11) and the combustion chamber (13), and with a control unit (20), including at least one actuation means (25) with which the valve (24) is opened for a predetermined time period. For improving, it is proposed to arranged in the fuel guide (12) a storage chamber (21) between the electronically controlled valve (24) and the combustion chamber (13). The storage chamber becomes filled with fuel through the electronically controlled valve already before the setting tool is pressed against a constructional component, enabling rapid, following one after another, setting processes.

9 Claims, 5 Drawing Sheets

COMBUSTION-ENGINED SETTING TOOL

BACKGROUND OF THE INVENTION

1. Field of the Invention

The present invention relates to a combustion-engined setting tool for driving fastening elements, primarily, in constructional components and including a fuel source, a combustion chamber, a fuel guide connecting the fuel source with the combustion chamber, at least one electronically controlled valve arranged in the fuel guide between the fuel source and the combustion chamber, and a control unit for opening the electronically control valve for a predetermined, by the control unit, time period.

2. Description of the Prior Art

Setting tools of the type described above operate on gaseous or liquid fuels which are combusted in the combustion chamber, driving the setting piston with which fastening elements are driven in.

Generally, with use of fuel, there exists a problem of admixing, for each operational cycle, a proper amount of air or oxygen, which is used as oxidation means, to the fuel. In particular, air, when taken from a surrounding environment, is subjected to pressure and temperature fluctuations which unfavorably influence the combustion of the air-fuel mixture, in particular when the fuel content in the mixture is too large or too small.

European Publication EP 0 597 241 B1 discloses a combustion-engined setting tool in which fuel is fed from a fuel source to the combustion chamber through a normally-closed solenoid valve. The solenoid is excited electronically, with the excitation being controlled by a switching circuit. The switching circuit opens the solenoid valve for a predetermined, adjustable time period in response to closing of an actuation switch. During this time period, fuel flows from the fuel source into the combustion chamber. The drawback of this tool consists in that the process of filling the combustion chamber starts only after the tool has been pressed against a constructional components into which a fastening element is to be driven, and the switch is actuated. This leads, in particular at low environmental temperatures, to a noticeable increase of the time period during which the combustion chamber is filled with fuel, which slows the setting process.

German Publication DE 42 43 617 A1 discloses a combustion-engined setting tool in which during an operational cycle, a gas inlet valve is mechanically opened and through which fuel flows from a fuel source into a storage chamber that communicates with the environment. Due to this communication, the pressure and, if necessary, the temperature can be balanced with the environmental air, so that a proper air-fuel mixture is fed into the combustion chamber. The mixture is fed from the storage chamber into the combustion chamber by a predetermined time. The drawback of the setting tool of DE 42 43 617 A1 consists in increased fuel losses.

Accordingly, an object of the present invention is to provide a setting tool in which the drawbacks of the prior art setting tools are eliminated.

Another object of the present invention is to provide a setting tool of the type described above with which rapidly following one another, setting processes can be effected.

A further object of the present invention is to provide a setting tool of the type described above and in which an optimal fuel metering becomes possible.

SUMMARY OF THE PRESENT INVENTION

These and other objects of the present invention, which will become apparent hereinafter, are achieved by providing in the fuel guide a storage chamber between the electronically controlled valve and the combustion chamber.

The storage chamber has no communication with the environment and is filled with fuel, through the electronically controlled valve, before the setting tool is pressed against a constructional component. Because the storage chamber is filled with fuel before the tool is pressed against a constructional component, rapidly following one another, setting processes can take place. Advantageously, the inventive setting tool includes mechanical actuating means that provides for connection of the storage chamber with the combustion chamber in response to the setting tool being pressed against a constructional component. Upon the connection of the storage chamber with the combustion chamber, a precisely metered volume of fuel is fed into the combustion chamber. In this way, together with an increased output, a precise metering of fuel becomes possible. The electronically controlled valve enables a precise metering of fuel in its liquid phase. In the storage chamber, preferably, the fuel is stored in a gaseous phase.

Advantageously, the setting tool includes, preferably, electronic actuation means that generates a valve opening signal when the setting tool is lifted off a constructional component with the control unit opening the electronically controlled valve for the predetermined time period in response to the opening signal generated by the electronic actuation means. In this way, the storage chamber is filled with fuel already when the setting tool is being lifted off a constructional component.

According to a further advantageous embodiment of the inventive setting tool, a piston is arranged in the storage chamber. Upon the setting tool being pressed against a constructional component, the piston is displaced by the mechanical actuating means, forcing the fuel from the storage chamber and into the combustion chamber. The displacement of the piston insures that the entire fuel volume, which is stored in the storage chamber, is fed into the combustion chamber.

Advantageously, a check valve is arranged between the storage chamber and the combustion chamber. The check valve is biased to its closed position and opens in response to a delivery displacement of the piston as a result of pressure build-up in the storage chamber. The check valve insures that the fuel would not flow prematurely into the combustion chamber, and no blow-back occurs when the mixture in the combustion chamber is ignited.

According to a further advantageous embodiment of the present invention, a shuttle valve is arranged in the fuel guide. The shuttle guide is displaceable between a first switching position, in which the shuttle valve connects the electronically controlled valve with the storage chamber, disconnecting the storage chamber from the combustion chamber, and a second switching position in which the shuttle valve connects the storage chamber with the combustion chamber disconnecting the storage chamber from the electronically controlled valve.

The shuttle valve is displaced from the first switching position to the second switching position in response to displacement of the mechanical actuating means from its initial position that corresponds to the initial position of the setting tool in which the storage chamber is disconnected from the combustion chamber and the electronically controlled valve is connected with the storage chamber, to its actuated position corresponding to a press-on position of the setting tool in which the storage chamber is disconnected from the electronically controlled valve and is connected with the combustion chamber. The shuttle valve is displaced from the second switching position to the first switching position in response to the displacement of the mechanical actuating means to its initial position upon lifting of the setting tool off a constructional component. The provision of the shuttle valve simplifies manufacturing of the setting tool in which the fuel flows from the storage chamber into the combustion chamber as a result of pressure existing in the storage chamber.

Advantageously, a check valve is provided in the fuel guide between the shuttle valve and the combustion chamber. The check valves open, against a biasing force, by pressure in the storage chamber. The check valve prevents a blowback when the mixture is ignited in the combustion chamber.

In order to adapt the amount of fuel, which is fed into the combustion chamber to parameters of the surrounding environment, e.g., temperature, air pressure, air humidity and to operational condition of the setting tool, there is provided sensor means for detecting the environmental parameters and for generating electronic signals. The acquired data are transmitted by appropriate data transmitting means to the control unit. The control unit determines, based on the transmitted data, the optimal amount of fuel to-be-fed into a combustion chamber for an operational cycle. The sensor means includes appropriate sensors.

Advantageously, the electronically controlled valve is formed as a solenoid valve. The use of the solenoid valve insures that the valve exactly follows the control command of the control unit and also provides for a cost-effective construction of the setting tool.

Advantageously, the control unit includes a data processing unit, e.g., a microprocessor or the like.

The microprocessor insures a quick processing of the input data and requires a reduced constructional space.

The novel features of the present invention, which are considered as characteristics for the invention, are set forth in the appended claims. The invention itself, however both as to its construction and its mode operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
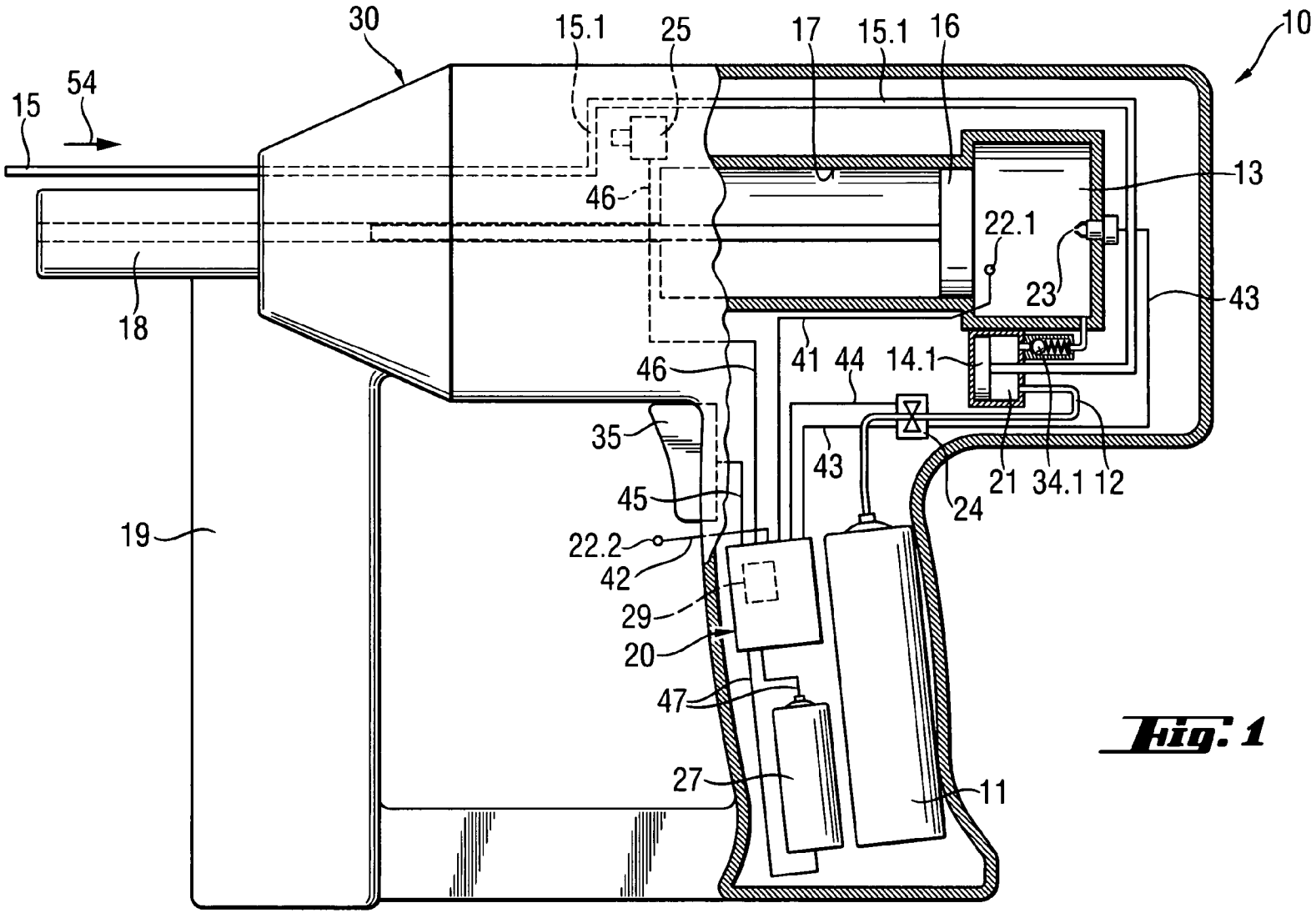
FIG. 1 a partially cross-sectional view of a setting tool according to the present invention in an initial position thereof.

A setting tool 10 according to the present invention, a first embodiment of which is shown in FIGS. 1–4, is operated with a fuel gas. The setting tool 10, which is shown in FIG. 1 in its initial or off position, has a housing 30 in which a setting mechanism is located. The setting mechanism is used for driving a fastening element such as, e.g., a nail, a bolt, or the like, in a constructional component (not shown in FIG. 1) when the setting tool 10 is pressed against the constructional component and is actuated.

The setting mechanism includes, among others, a combustion chamber 13, a piston guide 17 in which a drive piston 16 is displaceably arranged, and a bolt guide 18 for a fastening element and in which the fastening element is displaceable by a forward movable, setting direction end of the drive piston 16 to be driven in the constructional component. Fastening elements are usually stored, e.g., in a magazine 19 attachable to the setting tool 10.

In the embodiment shown in the drawings, in the combustion chamber 13, there is arranged an ignition unit, e.g., a spark plug 23, for igniting an air-fuel mixture fed into the combustion chamber 13 for effecting a setting process. Feeding of fuel into the combustion space or the combustion chamber 13 is effected through a fuel guide 12, e.g., a fuel conduit, from a fuel reservoir or a fuel source 11. In the fuel guide 12, there are arranged in a row, one after another, and downstream of each other, an electronically controlled valve, e.g., a piezoelectrical valve or a solenoid valve 24, a storage chamber 21, and a check valve 34.1.

In the storage chamber 21, a piston 14.1 is displaceably arranged. With the piston 14.1, a fuel volume, which fills the storage chamber 21, can be forced out therefrom. To this end, the piston 14.1 is connected by mechanical shifting means 15.1, e.g., an actuating linkage, with actuating means 15, e.g., an end actuator, arranged in a region of the bolt guide 18 of the setting tool 10.

The inventive setting tool further comprises an electronic control unit 20 which is connected with a power source 27, e.g., a battery or an accumulator, by an electrical conductor 47.

The control unit 20 is provided with data processing means 29, e.g., a microprocessor in which a control program for one or several of tool functions can be executed. The control unit 20 controls metering of fuel by controlling the operation of the electronically controlled valve 24.

The control unit 20 is connected with the electronically controlled valve 24 by an electrical conductor 44. An electrical conductor 43 connects the control unit 20 with the ignition unit 23. The end actuator or the actuating means 15 cooperates with an electronic actuation means 25 that is connected with the control unit 20 by an electrical conductor 46. An actuation switch 35, which is arranged on a handle of the setting tool 10, is connected with the control unit 20 by an electrical conductor 45. Further, the control unit 20 processes measurement data and parameters generated by sensor means 22.1, 22.2, e.g., a sensor for determining an air pressure or air humidity. The sensor means 22.1, 22.2 is connected with the control unit 20 by electrical conductors 41, 42. The electrical conductors 41, 42, 43, 44, 45, 46, 47 serve for both feeding electrical energy and transmitting electronic data.

In the initial or off position of the setting tool 10, which is shown in FIG. 1, the electronically controlled valve 24 is closed, and the storage chamber 21 is filled with a predetermined volume of gaseous fuel. However, the fuel cannot yet flow into the combustion chamber 13 as the check valve 34.1 is also closed.

Figure 2:
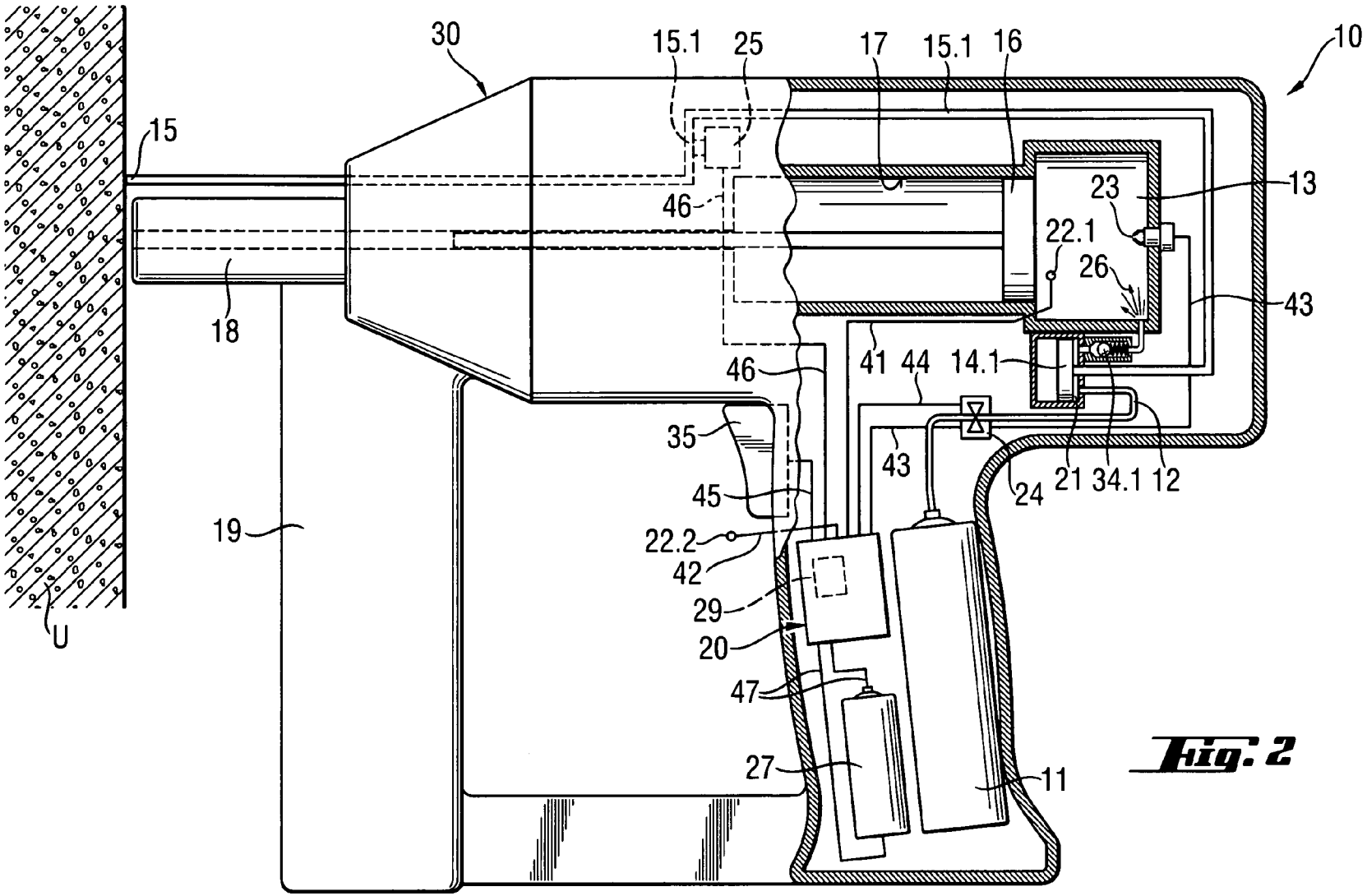
FIG. 2 a view similar to that of FIG. 1 but with the setting tool being slightly pressed against a constructional component.

In the position shown in FIG. 2, the setting tool 10 is placed on a constructional component U, and the end actuator or the actuating means 15 has been displaced along a first path (in a direction shown with arrows 54, See FIG. 1) into the setting tool 10. The displacement of the actuating means 15 is transmitted to the piston 14.1 via shifting means 15.1, whereby the piston 14.1 is also displaced along a corresponding path. The displacement of the piston 14.1 leads to reduction of the inner volume of the storage chamber 21 so that pressure in the storage chamber increases. The increased pressure in the storage chamber 21 leads to opening of the check valve 34.1, so that the fuel can flow into the combustion chamber 13 in the flow direction 26 through the open check valve 34.1.

Figure 3:
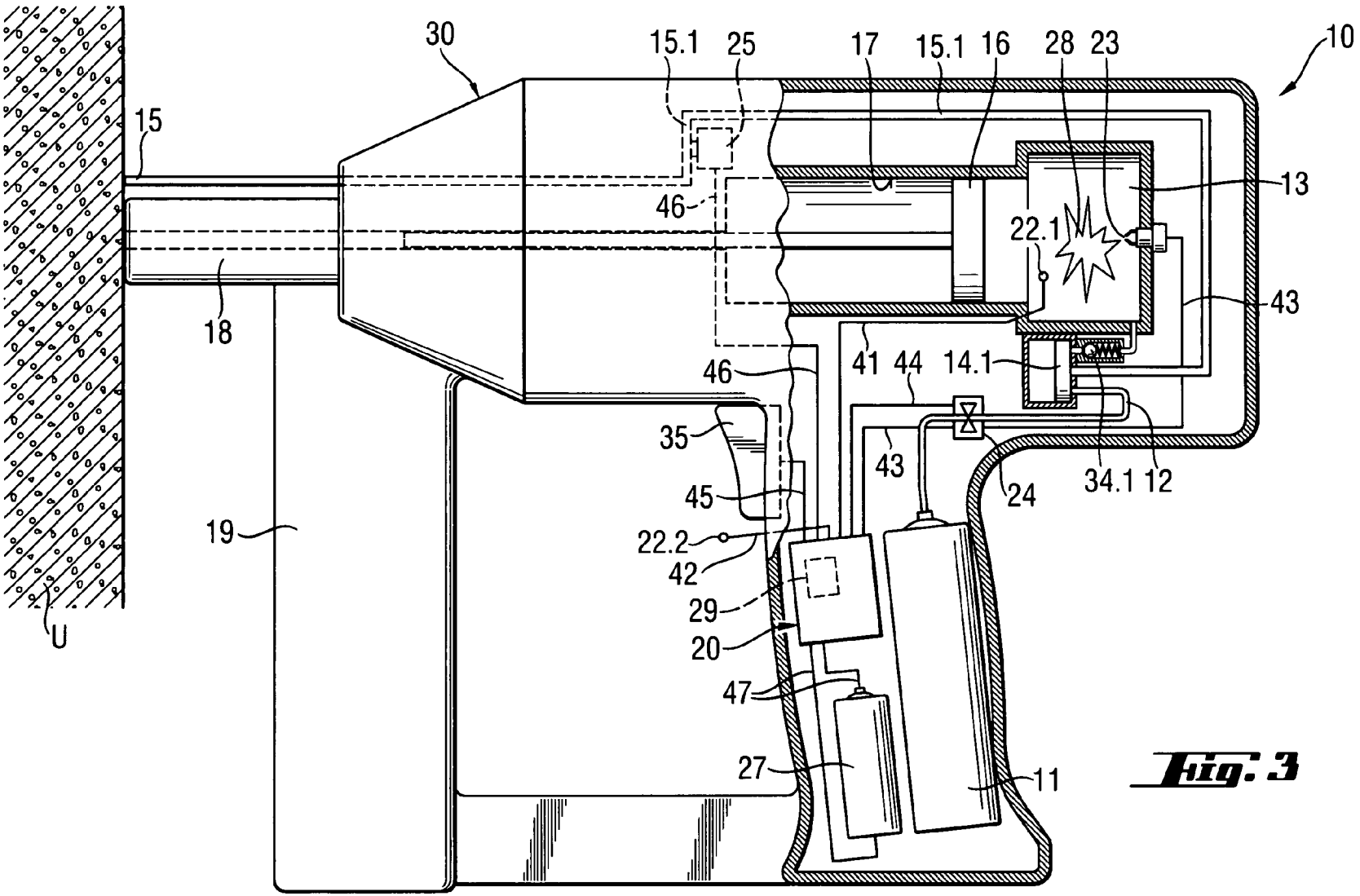
FIG. 3 a view similar to that of FIG. 1 but with the setting tool being completely pressed against the constructional component and with the setting process being actuated.
Figure 4:
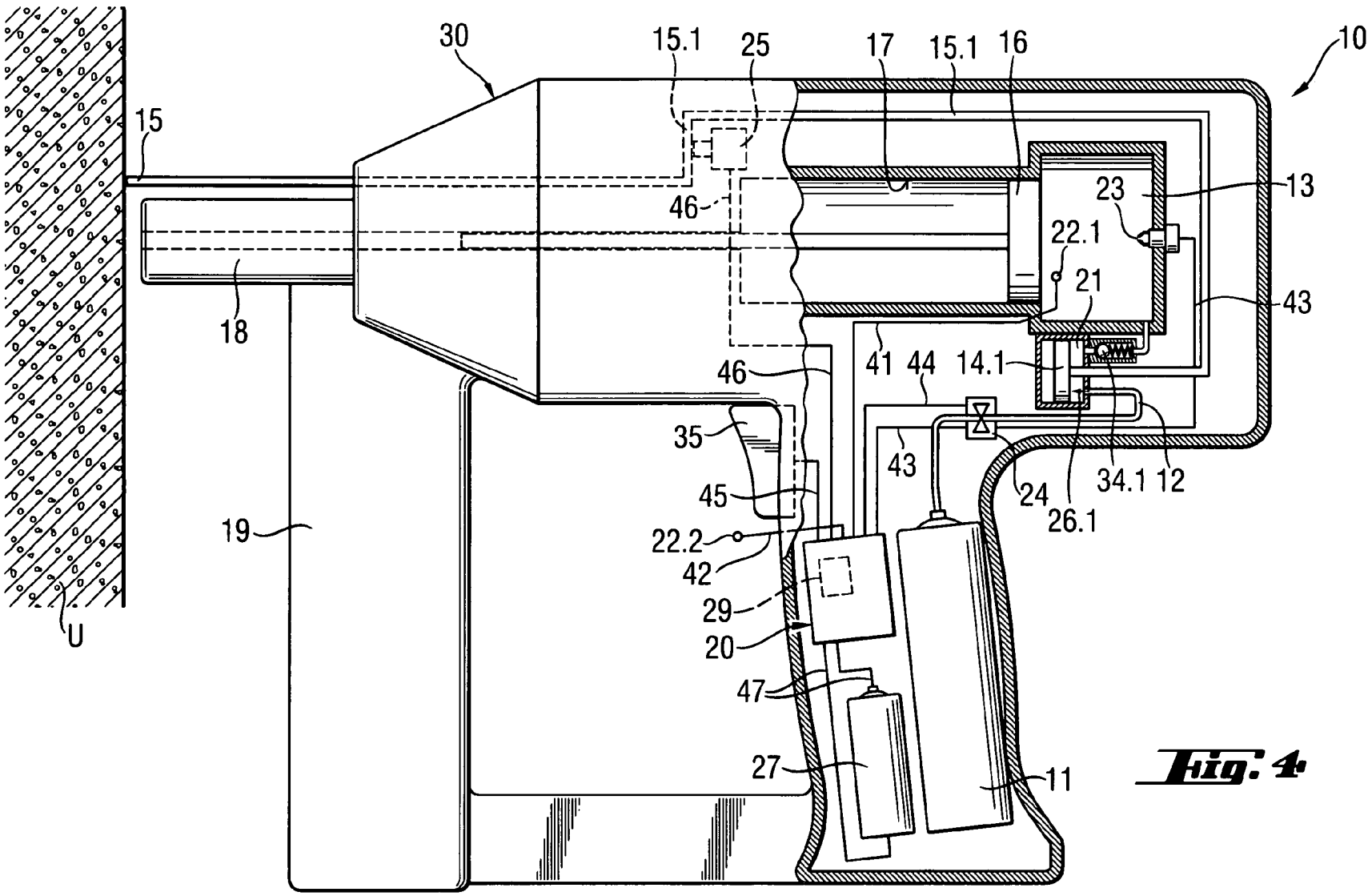
FIG. 4 a view similar to that of FIG. 1 but with the setting tool being lifted off of the constructional component.

In the position shown in FIG. 3, the setting tool is completely pressed against the constructional component U. The actuating means 15 has been displaced over the entire shifting path, and the piston 14.1 forced out the entire volume of fuel from the storage chamber 21 through the check valve 34.1 and into the combustion chamber 13. Simultaneously, the electronic actuation means 25 are actuated by the shifting means 15.1. The actuation of the actuation means 25 is communicated to the control unit 20 via the electrical conductor 46. The actuation switch 35 is actuated by a tool operator, with the actuation signal being transmitted to the control unit 20 via the electrical conductor 45. In response to the received actuation signal, the control unit 20 generates an ignition signal which is transmitted via the electrical conductor 43 to the ignition unit 23 which ignites, at 28, the air-fuel mixture in the combustion chamber 23. In this phase of operation of the setting tool 10, both valves 24 and 34.1 are closed.

In the position shown in FIG. 2, the setting tool 10 is placed on a constructional component U, and the end actuator or the actuating means 15 has been displaced along a first path (in a direction shown with arrows 54, See FIG. 1) into the setting tool 10. The displacement of the actuating means 15 is transmitted to the piston 14.1 via shifting means 15.1, whereby the piston 14.1 movable in a direction opposite the setting direction. Thereby, the volume of the storage chamber 21 has been increased. The mechanical shifting means 15.1 also opens electronic actuation means 25. The opening of the electronic actuation means 25 is monitored by the control unit 20 via the conductor 46. In response to opening of the actuation means 25, the control unit 20 generates a control signal which is transmitted by the conductor 44 to the electronically controlled valve 24.

In response to the control signal, the electronically controlled valve 24 opens for a time period preset by the control unit 20, and then closes again. The time period, during which the valve 24 remains open, is determined based on temperature and pressure information supplied by sensor means 22.1, 22.2. Thereby, an optimal adaptation of the amount of fuel to environmental conditions is achieved. The fuel flows into the storage chamber 21 through a first section of the fuel guide 12 in the direction shown with arrow 26.1 where it remains until the next setting step. After the setting tool 10 has been completely lifted of the constructional component U, it is ready for a new setting process.

Figure 5:
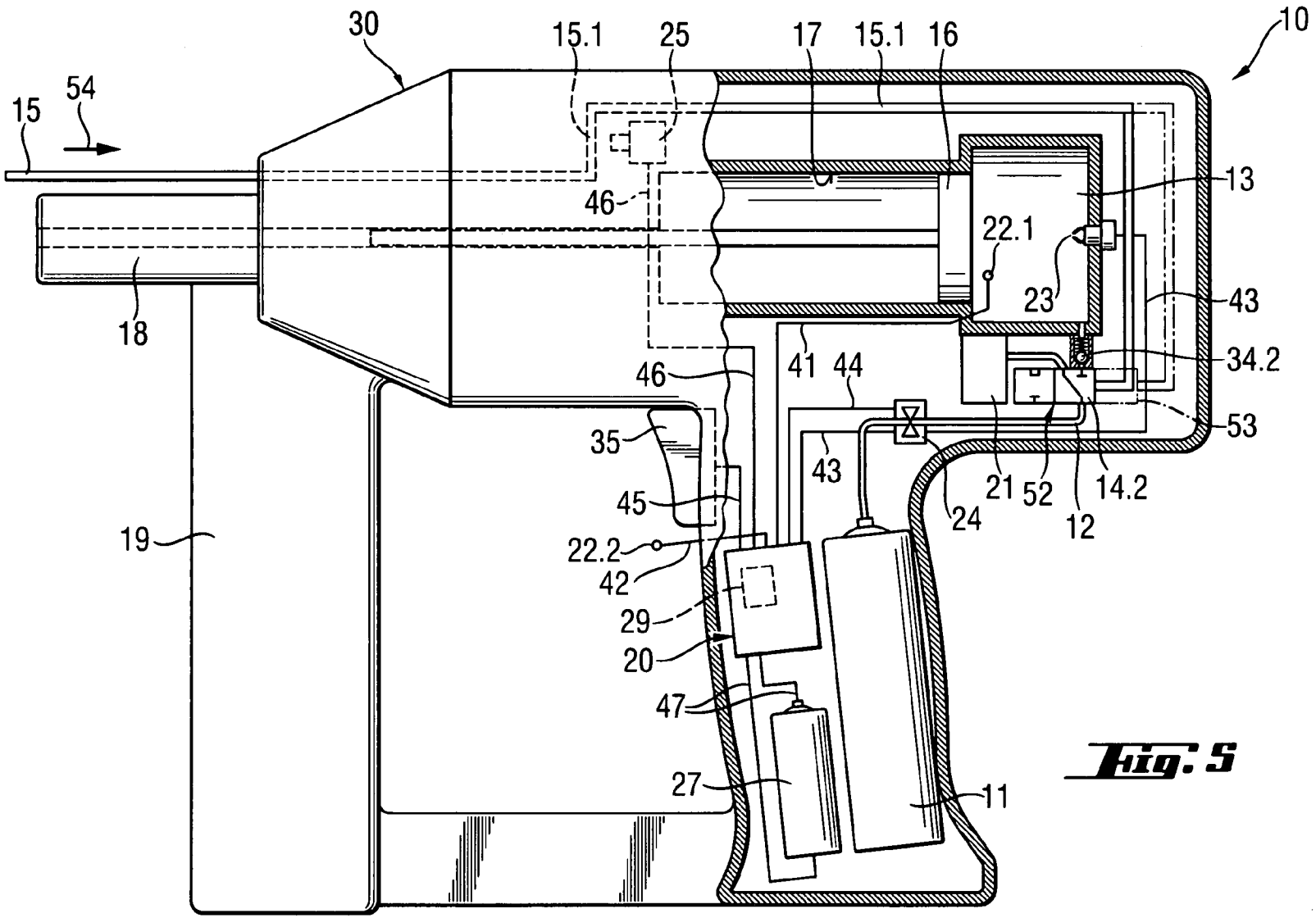
FIG. 5 a partially cross-sectional view of another embodiment of a setting tool according to the present invention in an initial position thereof.

FIG. 5 shows another embodiment of a setting tool 10 according to the present invention in its initial position. The setting tool 10 shown in FIG. 5 differs from that shown in FIGS. 1–4 in that a shuttle valve 14.2 is arranged in the fuel guide 12 alternatively between the storage chamber 21 and the electronically controlled valve 24 and between the storage chamber 21 and the check valve 34.1. The shuttle valve 14.2 is operated by the actuating means 15 via the shifting means 15.1.

The storage chamber 21, in the embodiment shown in FIG. 5, does not include a plunger, though a plunger can be integrated thereinto.

In FIG. 5, the shuttle valve 14.2 occupies a first switching position 52 in which it connects the storage chamber 21 with the electronically controlled valve 24. In the position shown in FIG. 5, the electronically controlled valve 24 is in its closed position.

Upon pressing of the setting tool 10 against a constructional component 10 in the direction opposite the setting direction shown with arrow 54, the actuating means 15 and the shifting means 15.1 displace the shuttle valve 14.2 to its second position 53 (shown with dashed lines). In the position 53, the shuttle valve 14.2 connects the storage chamber 21 with the combustion chamber 13. The check valve 34.2 is formed so that it opens as a result of pressure in the storage chamber 21 when the shuttle valve 14.2 connects, upon being displaced, the storage chamber 21 with the check valve 34.2.

In a press-on condition of the setting tool 10 (not shown), the actuation means 25 is closed, and ignition can take place in response to the ignition signal generated by the control unit 20 when an operator of the setting tool actuates the actuation switch 10.

When the setting tool 10 is lifted off a construction component (not shown), a reset spring displaces the shuttle valve 14.2 to its initial position 52 in which the shuttle valve 14.2 connects the storage chamber 21 with the electronically controlled valve 24. Simultaneously, the actuation means 25 opens, with the opening signal being transmitted via the conductor 46 to the control unit 20. As discussed above, in response to the opening signal, the control unit 20 opens, via the conductor 44, the electronically controlled valve 24 for a predetermined time period. Again, the control unit 20 presets the time period based on environmental conditions detected by sensor means 22.1, 22.2. For further details of the setting tool 10 shown in FIG. 5, reference should be made to the description of the tool shown in FIGS. 1–4.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool for driving fastening elements, comprising a fuel source (11); a combustion chamber (13); a fuel guide (12) connecting the fuel source (11) with the combustion chamber (13); at least one electronically controlled valve (24) arranged in the fuel guide (12) between the fuel source (11) an the combustion chamber (13); a control unit (20) for opening the electronically control valve (24) for a predetermined, by the control unit (20) time period; and a storage chamber (21) arranged between the electronically controlled valve (24) and the combustion chamber (13).

2. A setting tool according to claim 1, further comprising actuation means (25) that generates a valve opening signal when the setting tool is lifted off a constructional component (U), the control unit (20) opening the electronically controlled valve (24) for the predetermined time period in response to the opening signal generated by the actuation means (25).

3. A setting tool according to claim 1, further comprising actuating means (15) actuatable when the setting tool (10) is pressed against a constructional component (U); and a piston (14.1) arranged in the storage chamber (21) and displaceable in response to actuation of the actuating means (15).

4. A setting tool according to claim 1, further comprising a check valve (34.1) arranged in the fuel guide (12) between the electronically controlled valve (24) and the combustion chamber (5).

5. A setting tool according to claim 1, comprising actuating means (15) having an initial position corresponding to an initial position of the setting tool (10) in which the storage chamber (21) is disconnected from the combustion chamber (13) an the electronically controlled valve (24) is connected with the storage chamber (21), and an actuated position corresponding to a press-on position of the setting tool in which the storage chamber (21) is disconnected from the electronically controlled valve (24) and is connected with the combustion chamber (13); and a shuttle valve (14.2) arranged in the fuel guide (12) for displacement between a first switching position (52) corresponding to the initial position of the actuating means (15) and in which the shuttle valve (14.2) connects the electronically controlled valve (24) with the storage chamber (21); disconnecting the storage chamber (21) from the combustion chamber (13), and a second switching position (53) corresponding to the actuated position of the actuating means (15) and in which the shuttle valve (14.2) connects the storage chamber (21) with the combustion chamber (13), disconnecting the storage chamber (21) from the electronically controlled valve (24).

6. A setting tool according to claim 5, further comprising a check valve (34.2) provided in the fuel guide (12) between the shuttle valve (14.2) and the combustion chamber (13).

7. A setting tool according to claim 1, further comprising sensor means (22.1, 22.2) for detecting air pressure, temperature, and air humidity, and data transmitting means (41, 42) for connecting the sensor means (22.1, 22.2) with the control unit (20).

8. A setting tool according to claim 7, wherein the control unit (20) comprises a data processing unit (29) for evaluation and processing of data transmitted by the data transmitting means.

9. A setting tool according to claim 1, wherein the electronically controlled valve (24) is formed as a solenoid valve.

* * * * *